United States Patent [19]

Pfeiffer

[11] 4,137,683

[45] Feb. 6, 1979

[54] DECORATIVE OBJECT COMPRISING PANELS JOINED WITH SLIDE FASTENERS

[76] Inventor: Werner B. Pfeiffer, Flat Rock Rd., Cornwall Bridge, Conn. 06754

[21] Appl. No.: 844,033

[22] Filed: Oct. 20, 1977

[51] Int. Cl.[2] ..... E04B 1/38

[52] U.S. Cl. ..... 52/506; 160/368 R; 160/DIG. 18

[58] Field of Search ..... 5/344; 272/56.5, 109; 160/368 G, 368 R, 368, DIG. 18; 428/52, 33; 156/71; 52/506, 511-582

[56] References Cited

U.S. PATENT DOCUMENTS

| | | | |
|---|---|---|---|
| 2,269,964 | 1/1942 | Watson | 160/DIG. 18 |
| 3,319,273 | 5/1967 | Solin | 5/344 |
| 3,391,434 | 7/1968 | Girard | 52/DIG. 13 |
| 3,526,911 | 9/1970 | Meyer et al. | 272/109 X |
| 3,621,625 | 11/1971 | Medow | 52/314 |
| 3,856,072 | 12/1974 | Sund | 160/DIG. 18 |

FOREIGN PATENT DOCUMENTS

| | | | |
|---|---|---|---|
| 574720 | 4/1959 | Canada | 160/DIG. 18 |
| 1289461 | 2/1962 | France | 5/344 |

*Primary Examiner*—Henry F. Epstein
*Attorney, Agent, or Firm*—Dallett Hoopes

[57] ABSTRACT

Decorative object comprises a plurality of panels joined by slide fasteners. Surface ornamentation on the assembled panels may be continuous. Preferably, all of the panels are a single ply sheet of a woven fabric such as canvas. The decorative object is secured to support means.

1 Claim, 4 Drawing Figures

DECORATIVE OBJECT COMPRISING PANELS JOINED WITH SLIDE FASTENERS

BACKGROUND OF THE INVENTION

Field of the Invention

This invention relates to a decorative object comprising a plurality of panels joined by slide fasteners. More specifically, the invention relates to an assembly of such panels having surface ornamentation.

SUMMARY OF THE INVENTION

The invention relates to a decorative object comprising a plurality of panels, each panel having at least two connecting margins, the said two connecting margins of one panel being adjacent respectively with individual connecting margins of two other panels, and the adjacent margins being joined by slide fasteners, the thus assembled panels having surface ornamentation thereon.

BRIEF DESCRIPTION OF THE DRAWINGS

Other objects of the invention will be apparent from the following specification and appended drawings, all of which disclose a non-limiting embodiment of the invention. In the drawings.

DESCRIPTION OF THE PREFERRED EMBODIMENT

Figure 1:
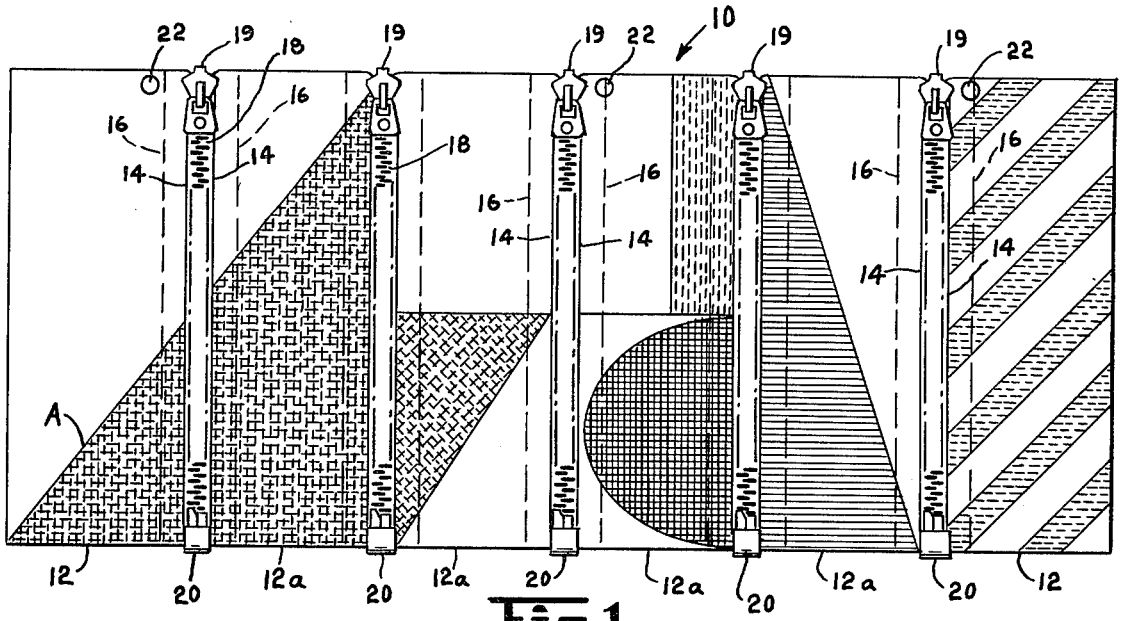
FIG. 1 is a front elevational view of an assembly embodying the invention.

Referring more specifically to the drawings, an assembly embodying the invention is generally designated 10 in FIG. 1. It comprises a decorative object comprising a plurality of flexible panels. The end panels are designated 12 while the intermediate panels are designated **12*a***. Preferably, all of the panels are a single ply sheet of a woven fabric such as canvas.

The panels 12 each present at least one connecting margin 14 and the intermediate panels **12*a* each present two connecting margins 14. As shown, the connecting margins 14 of any of the intermediate panels 12*a* are adjacent respectively with individual connecting margins 14 of two other panels. The adjacent pairs of margins have secured thereto the respective stringers 16 of a slide fastener chain 18**.

Figure 4:
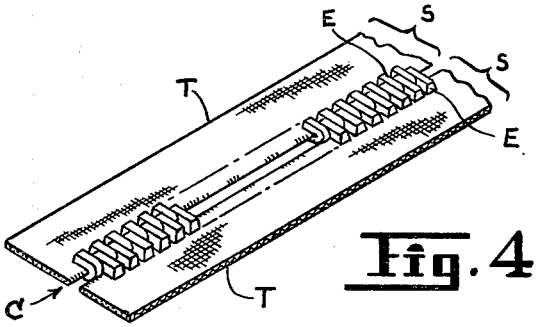
FIG. 4 is a perspective view of a length of conventional slide fastener chain.

As is well-known in the art (FIG. 4), a slide fastener chain C comprises a pair of stringers S, each stringer including a line of fastener elements E or teeth adapted to interengage with the elements E of a similar line. The stringers also, but not necessarily, each include a fabric tape T to which the line of fasteners is usually sewn.

In the present embodiment, the stringers 16 are preferably sewn to the fabric of the adjacent connecting margins 14, respectively.

The object is held together by the interengagement of the lines of fastener elements of the respective chains sewn to the adjacent connecting margins, as shown. The slide fastener sliders 19 are operatively associated with the individual chains, and preferably the chains are of the separable type including the conventional box-pin connection at one end, preferably the lower end, shown at 20.

It is an essential part of the invention that the fastener connecting the adjacent connecting margins be readily apparent to the observer of the object. Preferably, the slide fasteners are made especially conspicuous by their color and/or shape so that the slide fastener becomes a definite visual part of the decorative object.

The panels 12 and **12*a* carry surface ornamentation. In an embodiment of the invention, the surface ornamentation is continuous from one panel to the next with definite lines running continuous fashion in the design across a line of slide fasteners, as shown at A in FIG. 1**.

Alternatively, the surface decorations may be discontinuous so that each panel does not depend on its neighbors as part of a meaningful design and the panels may be unzipped from their neighbors and their order may be changed as desired and then the panels may be reassembled by again zipping up the slide fasteners. Such ornamentation is shown in FIG. 1 except for the two leftward panels.

Figure 2:
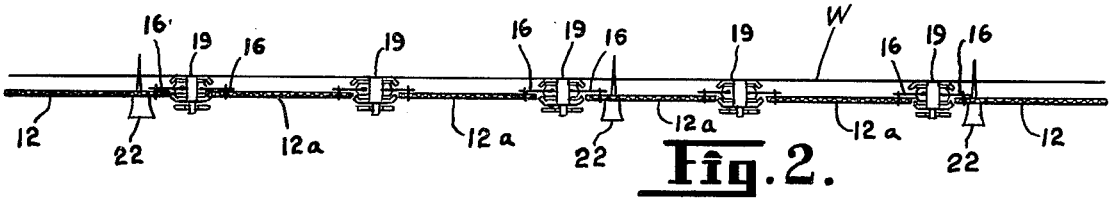
FIG. 2 is a top plan view of the embodiment.

FIG. 2 shows the assembly in planar form as when the assembly is laid flat against a wall W and secured there as by push pins 22, or the like.

Figure 3:
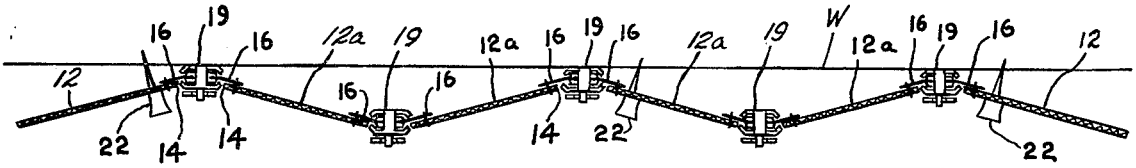
FIG. 3 is a top plan view of a modified form of the invention.

In a modification (FIG. 3), the panels may be hung to a wall W or the like in a manner such that the distance between push pins is less than the length of assembly between the push pins so that the panels between the push pins tend to zigzag. This gives a three-dimensional aspect to the object.

While the invention has been disclosed in but a limited number of forms, it is only limited as defined in the following claim language and equivalents:

I claim:

1. In combination, a decorative object comprising a plurality of panels, each panel being a thin single ply sheet of woven fabric and having two opposite connecting margins, the said two connecting margins of one panel being parallel to each other and adjacent respectively to individual connecting margins of two other panels, the margins comprising each pair of adjacent connecting margins having secured thereto the respective stringers of a separable slide fastener chain, said separable slide fastener stringers each comprising a row of spaced teeth, the rows being uncovered and readily apparent to the observer of said object and being interengaged and serving as the sole connecting means to integrate the panels into an assembly, the assembled panels having surface ornamentation thereon; and flat vertical supporting means underlying said object and securing elements supporting said object against said supporting means, said object being secured to said support means with at least one line of fasteners spaced from said support means and at least one adjacent line of fasteners engaging said support means to give a three-dimensional aspect to said object.

* * * * *